US006435324B1

(12) United States Patent
Hoberman

(10) Patent No.: US 6,435,324 B1
(45) Date of Patent: Aug. 20, 2002

(54) LUGGAGE WITH ADJUSTABLE PACKING BOARD

(75) Inventor: Barry Wayne Hoberman, Boca Raton, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 09/625,331

(22) Filed: Jul. 25, 2000

(51) Int. Cl.[7] ..... A45G 3/00
(52) U.S. Cl. ..... 190/110; 190/36; 206/292
(58) Field of Search ..... 206/292, 278; 190/109, 110, 111, 36

(56) References Cited

U.S. PATENT DOCUMENTS

| | | | | | |
|---|---|---|---|---|---|
| 1,975,294 | A | * | 10/1934 | Sand et al. | 190/110 X |
| 3,410,445 | A | * | 11/1968 | Pilley | 220/551 |
| 3,570,570 | A | | 3/1971 | Winner | |
| 3,933,229 | A | * | 1/1976 | Pelavin | 190/110 X |
| 4,061,224 | A | * | 12/1977 | Fuhri | 220/551 X |
| 4,154,323 | A | * | 5/1979 | Sneider | 190/2 |
| 4,263,951 | A | * | 4/1981 | Siegel | 190/110 |
| 4,273,223 | A | | 6/1981 | Tomlinson | |
| 4,453,623 | A | * | 6/1984 | Horli | 190/110 X |
| 4,580,667 | A | | 4/1986 | Herwood | |
| 4,643,281 | A | | 2/1987 | Erickson | |
| 4,854,432 | A | | 8/1989 | Carpenter et al. | |
| 4,854,602 | A | * | 8/1989 | Takeuchi | 190/110 X |
| 4,887,751 | A | | 12/1989 | Lehman | |
| 4,889,253 | A | * | 12/1989 | Schmulian et al. | 220/551 |
| 4,901,899 | A | * | 2/1990 | Barrett | 224/223 |
| 5,096,030 | A | | 3/1992 | Espinosa et al. | |
| 5,195,620 | A | * | 3/1993 | Tate | 190/110 X |
| 5,413,198 | A | | 5/1995 | Ferris | |
| 5,566,797 | A | * | 10/1996 | Van Himbeeck | 190/115 X |
| 5,857,568 | A | * | 1/1999 | Speirs | 206/320 |
| 6,000,509 | A | | 12/1999 | Chisholm | |

* cited by examiner

*Primary Examiner*—Lee Young
*Assistant Examiner*—Tri M. Mai
(74) *Attorney, Agent, or Firm*—Ackerman Senterfitt

(57) ABSTRACT

Luggage for carrying clothing, accessories and the like when traveling includes an adjustable packing board having first and second panels that are joined together between first and second luggage attachment ends. A pair of drawstrings are fixed at bottom ends to opposite ends of a luggage bottom and slidably connected to the attachment ends of the panels. The drawstrings can be loosened and tightened to move the packing board away from and toward the luggage bottom. The first and second panels can be separated and swung away from each other. These features allow the packing board to be moved out of the way when packing and unpacking the luggage. The packing board may also include detachable and fixed zippered compartments for containing travel items.

11 Claims, 3 Drawing Sheets

LUGGAGE WITH ADJUSTABLE PACKING BOARD

CROSS-REFERENCE TO RELATED APPLICATIONS (Not applicable.)

STATEMENT REGARDING FEDERALLY SPONSORED RESEARCH AND DEVELOPMENT (Not applicable.)

BACKGROUND OF THE INVENTION

The present invention relates to luggage and, more particularly, to luggage having a packing board divider.

Luggage having compartments to store common travel items such as clothes, toiletries and other accessories are well known in the art. Similarly, luggage having flat panels or packing boards for dividing the storable volume of the luggage and providing an additional packing surface are also well known in the art, see e.g. U.S. Pat. No. 4,854,432 issued to Carpenter et al. It is also well known that such packing boards may have pockets or compartments, see e.g. the above mentioned patent and U.S. Pat. No. 6,000,509 to Chisholm, U.S. Pat. No. 4,273,223 to Tomilinson and U.S. Pat. No. 3,570,570 to Winner, the disclosures of which are hereby incorporated by reference as though fully set forth herein.

One problem with conventional packing boards is that they can hamper access to items stored beneath the boards. This can make it difficult to pack and unpack items at the bottom of the luggage. To overcome this problem, luggage has been developed with removable packing boards, see e.g. the '432 patent mentioned above. Not only does this allow for unfettered access to the full storage volume of the luggage, it also allows items stored in compartments on the packing board to be carried or stored separate from the main housing of the luggage. While this can be an advantage, the packing board and items it contains are more readily forgotten and lost when separated from the luggage. Moreover, to carry or store the items in the packing board apart from the main housing, one must also carry the board itself, which can be awkward given its generally panel-like construction. Further, the packing board does not provide its compartmentalizing and supporting functions when removed from the luggage for use as a separate carrying case.

Accordingly, there is a need for luggage with an improved packing board.

SUMMARY OF THE INVENTION

The present invention provides luggage with an adjustable packing board that remains fastened to the luggage yet can be moved up and down as well as split in two and swung out to the ends of the luggage to provide unfettered access to the luggage when packing and unpacking.

In particular, the invention is a packing board for dividing the storage volume of luggage and supporting items such as clothing, accessories and the like. The packing board includes two panels each attached at opposite ends of the luggage. The panels are removably fastened together between their attachment ends. The panels are adjustably attached at the opposite ends of the luggage so that the packing board can be moved with respect to the luggage.

In one preferred form, the panels of the packing board may be separated from one another and pivoted or swung out to the ends of the luggage in addition to, or instead of, being moved up and down relative to the luggage. Preferably, the panels are connected together via a hook and loop fastener and to the luggage by adjustable drawstrings. The drawstrings or other similar structure act as tensioners for adjustably urging the packing board toward items stored within the volume of luggage for compressing and securing same.

In another form, one of the panels includes at least one compartment for storing items. Preferably, the panel includes two compartments, one permanently fixed thereto and one that is detachable. The detachable compartment preferably is a transparent and water resistant zippered case.

One aspect of the invention includes a luggage for carrying clothing, accessories and the like having a housing with a bottom and sides hinged and zippered to a top. A packing board as described above is sized to fit within the housing. A pair of drawstrings are each fixed at one end to opposite ends of the housing bottom and slidably connected to the attachment ends of first and second panels of the packing board. When the drawstrings are loosened the packing board can be moved into and out of the housing and alternatively or additionally the first and second panels can be separated and swung away from each other. Preferably, the first panel includes a snap-on detachable zippered case and a fixed zippered case.

It is therefore a principle object of this invention to provide luggage which includes a packing board that can be quickly and easily moved out of the way when packing and unpacking the luggage. This is accomplished by attaching the packing board to the luggage by adjustable drawstrings. Additionally, this is accomplished by pulling the panels apart and rotating them up and out to the ends of the luggage. The panels can be swung out to the ends when the drawstrings are loosened so that the panels can rest completely outside of the luggage. Alternatively, when the drawstrings are tightened so as to hold the packing board in place within the luggage, the panels can be separated and pivoted upright within the luggage for quick access to items below the packing board.

It is a further object of the invention to allow the packing board to be moved without being physically separated from the bag. This is accomplished by the split panel construction and the adjustable drawstring connection in which one end of the drawstrings is fixed to the bottom of the luggage.

Another object of the invention is to provide a packing board with fixed and detachable storage compartments. This is accomplished by having zippered cases snapped to and permanently affixed to one or both of the panels.

In accordance with these and other objects which will become apparent hereinafter, the present invention will now be described with particular reference to the accompanying drawings.

DETAILED DESCRIPTION OF THE PREFERRED EMBODIMENTS

Figure 1:
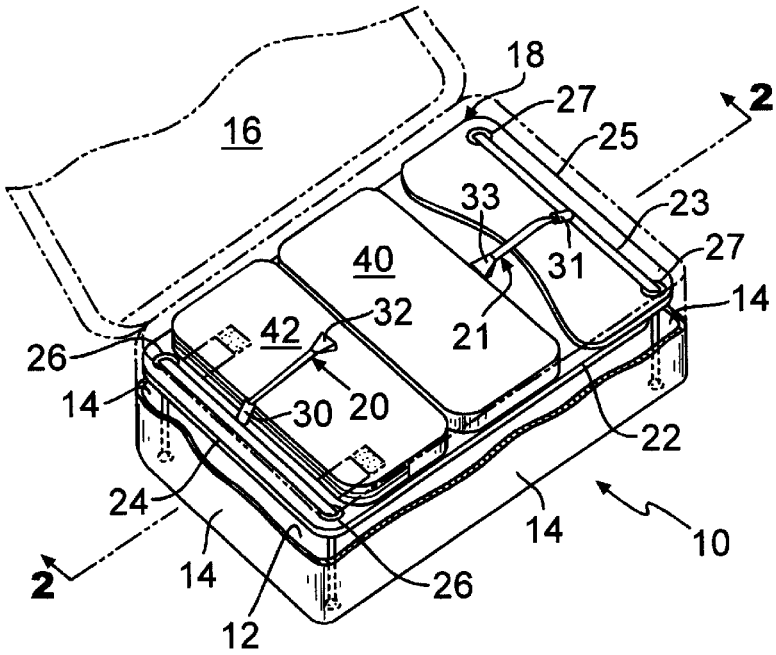
FIG. 1 is a front perspective view of a luggage having an adjustable two panel packing board according to the present invention.

Referring to FIG. 1, luggage 10 defines a housing with a bottom 12, upright sides 14 and a top 16 hinged, and reclosably attached via a zipper (not shown), to the sides 14 to create a storage volume for holding clothes, accessories and the like. The luggage 10 includes a packing board 18 adjustably attached to the bottom 12 via a pair of drawstrings 20 and 21 so that it can be moved into and out of the storage volume of the luggage.

Figure 3:
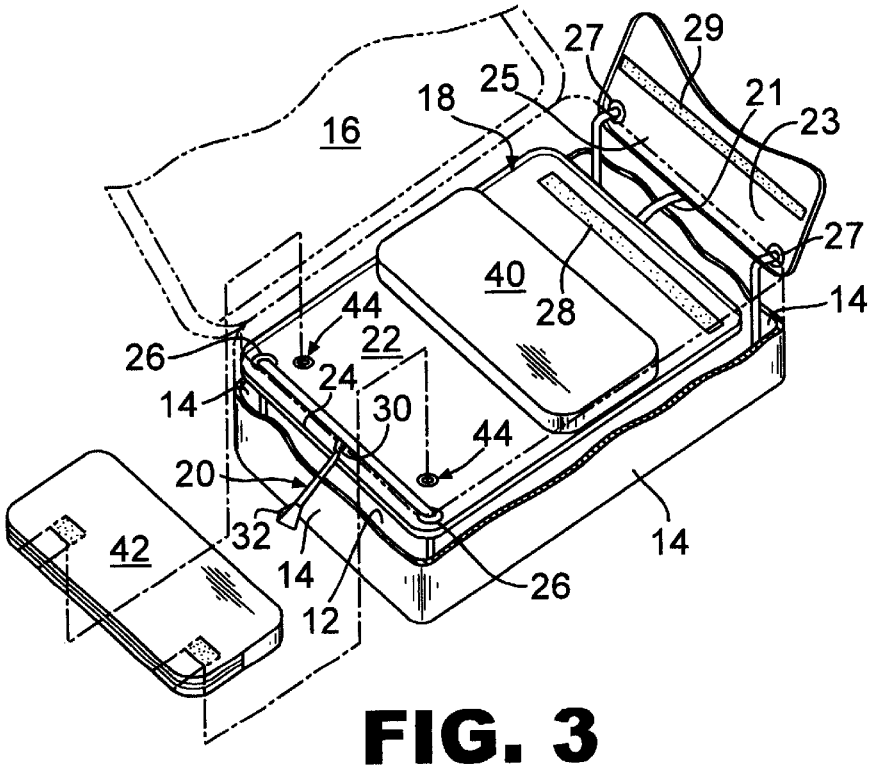
FIG. 3 is a front perspective view similar to FIG. 1 showing the panels separated and one panel pivoted upright as well as showing a detachable compartment removed from the packing board.

Referring to FIGS. 1 and 3, the packing board 18 consists of two flat, generally planar panels 22 and 23 each having a width slightly less than that of the luggage 10. In the preferred embodiment shown and described herein, panel 22 is larger than then panel 23, however, the panels could be more or less the same size. Each panel 22 and 23 has an attachment end 24 and 25 with a pair of openings for metallic eyelets 26 and 27. Each panel 22 and 23 also has a complementary part, 28 and 29 respectively, of a hook and loop fastener affixed at the ends opposite the attachment ends 24 and 25. One of the hook and loop parts is attached to the bottom side of panel 23 and the other is attached to the top side of panel 22. The panels 22 and 23 are sized, and the fastener is positioned, so that when the panels 22 and 23 are connected the overall length of the packing board 18 is slightly less than the length of the luggage 10 so that it fits easily therein. When the panels 22 and 23 are connected the eyelets 26 of panel 22 can be aligned in parallel with the eyelets 27 of panel 23. The panels 22 and 23 are separated by pulling up on the overlapping lip of the smaller panel 23 so that the complementary members 28 and 29 of the hook and loop fastener are disengaged.

Figure 2:
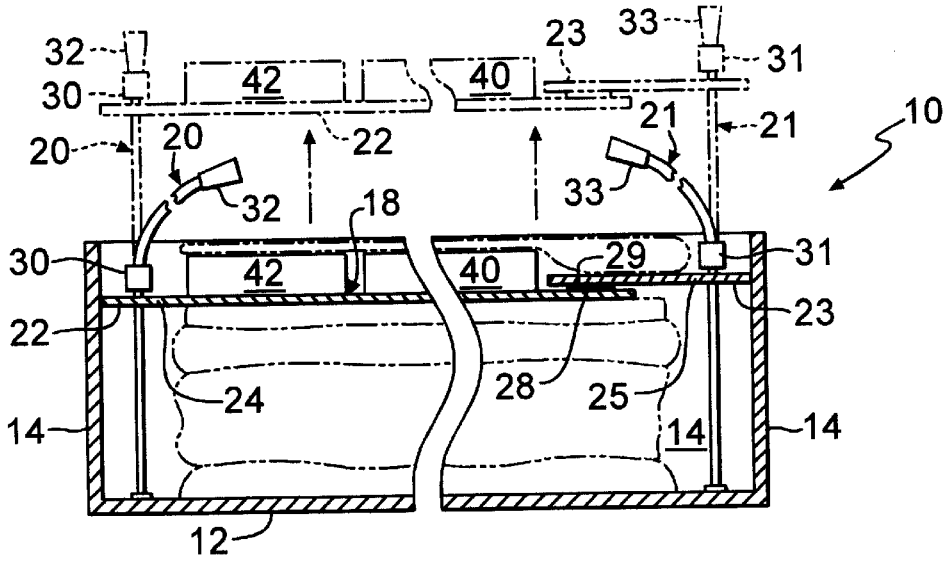
FIG. 2 is a front cross-sectional view along line 2—2 of FIG. 1 without the top and showing the packing board in a lowered position with adjustable drawstrings tightened to hold the packing board down against items therebelow, in phantom the drawstrings are shown loosened and the packing board is raised for moving the packing board out of the luggage when packing or unpacking the luggage.

Referring to FIG. 2, the drawstrings 20 and 21 each include a pair of cords that are fixed at one end to the bottom 12 at opposite ends of the luggage 10. Preferably, the cords are attached near the four corners of the luggage 10 in vertical alignment with the eyelet 26 and 27 of the respective panels 22 and 23. Any suitable means of attaching the cords to the luggage 10 may be used, such as mechanical fasteners, stitching, etc. The cords are shown and described herein as be fixed to the luggage. This is the preferred embodiment since it reduces associated connection problems for the user and prevents one or more of the cords from being lost. However, it should be noted that it is within the scope of the invention to include drawstring cords that are designed to be detachable.

Each of the cords fits through a corresponding eyelet 26 and 27 of the panels 22 and 23. Each pair of cords are united by respective adjustable clasps 30 and 31, as known in the art, located along the portion of the cords above the packing board. The free ends of each pair of cords are knotted within respective pulls 32 and 33. As such, the panels 22 and 23 are secured to the luggage 10 via the drawstrings 20 and 21. While this is preferred, the pulls 32 and 33 (as well as the clasps 30 and 31) could be detachable so that the packing board can be separated from the luggage 10.

As shown in FIG. 2, the height of the packing board can be changed by loosening the clasps 30 and 31 and sliding the panels 22 and 23 along the drawstring cords. This allows the panels 22 and 23 to be pulled out of the luggage storage volume completely when packing or unpacking.

Figure 4:
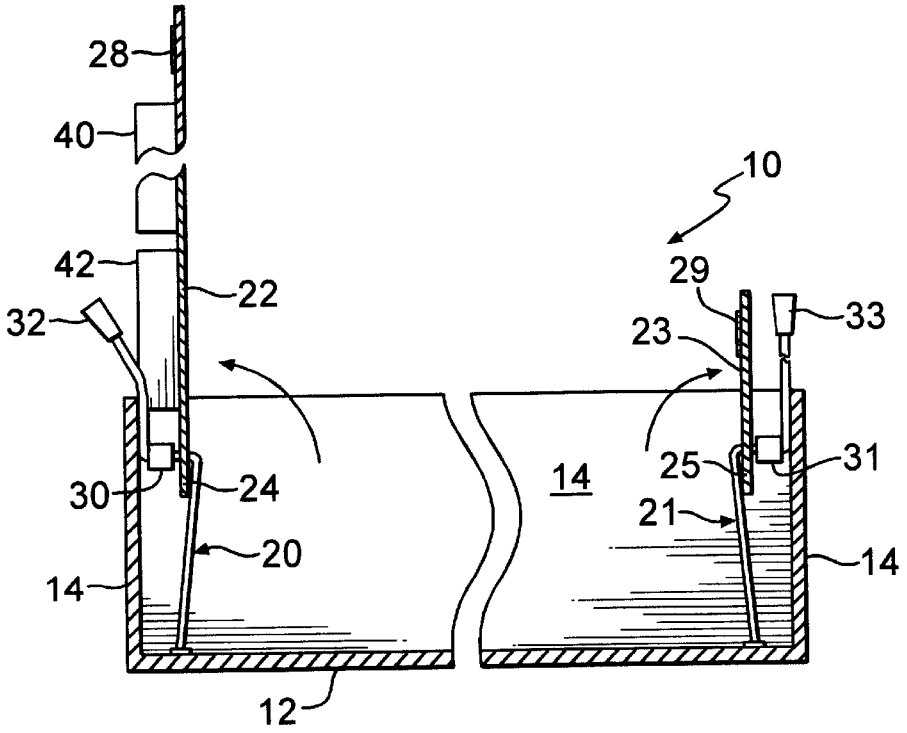
FIG. 4 is a front cross-sectional view similar to FIG. 2 with both panels of the packing board upright at the ends of the luggage without loosening the drawstrings.
Figure 5:
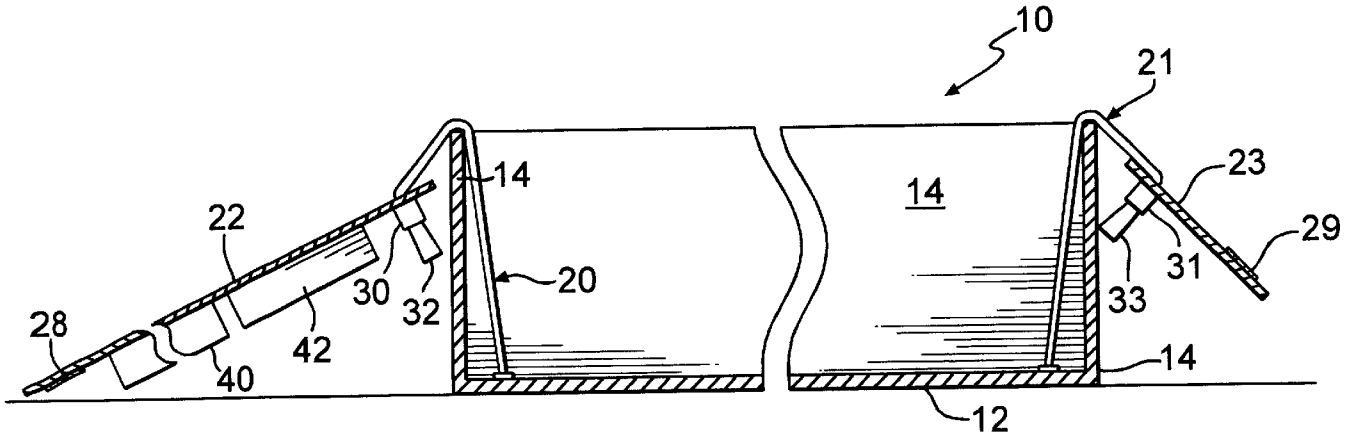
FIG. 5 is a front cross-sectional view similar to FIG. 2, with the drawstrings loosened and both of the panels separated and completely outside of the luggage.

Referring to FIGS. 3 and 4, the restrained freedom of the drawstring connection not only permits the packing board 18 to be raised and lowered, but it also permits each panel 22 and 23 to be pivoted or otherwise swung out to the ends of the luggage 10 when the panels 22 and 23 are separated, as described above. As shown in FIG. 4, the panels 22 and 23 can be moved upright at the ends without loosening the drawstrings 20 and 21, which makes accessing the bottom of the luggage 10 quick and easy. Alternatively, increased access inside the luggage 10 is provided by loosening the drawstrings 20 and 21 and separating the panels 22 and 23 so that they can be completely removed from the inside of the luggage 10 with only the drawstring cords extending from the bottom 12 of the luggage 10 and draping over the upright sides 14, as shown in FIG. 5.

The packing board 18 serves the functions of conventional packing boards; namely dividing up the storage space of the luggage 10 and providing a support shelf for items in the upper part of the luggage 10. In addition, however, the packing board 18 of the present invention distributes the weight of the items in the upper part of the luggage 10 to inhibit crushing fragile items and wrinkling clothes below the packing board. At the same time, the packing board 18 acts as a hold down by tightening the drawstrings 20 and 21 so that the packing board 18 is held against items in the lower part of the luggage 10, thereby reducing the likelihood of items being tossed about and broken during transport. In particular, drawstrings 20, 21 are tensioned as clasps 30, 31 are forced downwardly against the packing board 18 to evenly compress items stored in the luggage. When the desired degree of compression is obtained, the clasps can be locked relative to drawstrings 20, 21 so as to securely hold the packing board in the desired position. This is a distinct advantage over conventional packing board designs which merely serve to divide luggage compartments.

Referring again to FIGS. 1 and 3, the packing board also provides additional storage compartments. Specifically, two zippered compartments 40 and 42 are attached to panel 22. Preferably, compartment 40 is lined by a soft material permanently affixed to the top side of the panel 22 by suitable stitching, adhesive or mechanical fastener. Compartment 42 is preferably made of a transparent and waterproof material suitable from holding wet or liquid-containing items. Compartment 42 is also designed to be detachable so that the items stored therein can be easily transported apart from the luggage 10. For this purpose, a pair of snap connectors 44 are used with complementary members affixed to the panel 22 and the bottom of the compartment 42. While snap connectors have been shown and described herein, any other suitable detachable fastener could be used, such as a hook and loop fastener.

In a preferred form, the luggage housing and the fixed compartment 40 are a durable, heavy grade nylon. The panels 22 and 23 are made of covered rigid PE board and nylon. The drawstring cords are nylon, and the detachable compartment 42 is a transparent polyvinylchloride material.

Figure 6:
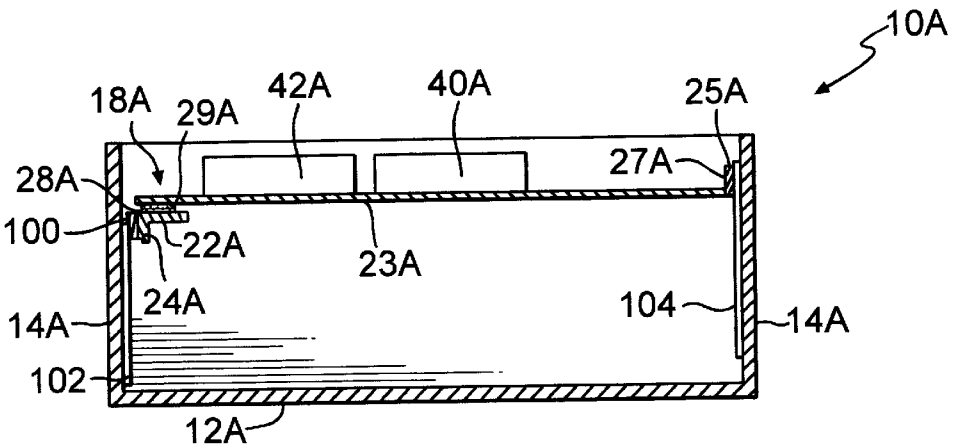
FIG. 6 is front cross-sectional view similar to FIG. 2 of an alternate embodiment of the luggage in which the packing board has one full-size panel attached at one end of the luggage by a drawstring and one narrow panel attached to an upright side of the luggage at an end opposite the drawstring.

An alternate embodiment of the luggage and packing board is shown in FIG. 6. Similar reference numbers refer to corresponding features described in the above embodiment albeit with the suffix "A". As above, the luggage 10A defines a housing with a bottom 12A, upright sides 14A and a top (not shown). A packing board 18A includes two panels 22A and 23A each having a width slightly less than that of the luggage 10A. Panel 23A is a flat, rectangular panel sized slightly smaller than the full opening defined by the sides 14A and made of suitable PE board. Panel 22A is a narrow strip structure preferably also made of PE board.

As in the embodiment described above, each of the panels 22A and 23A includes respective complementary members 28A and 29A of a hook and loop fastener affixed in opposing fashion with member 28A on the top surface of panel 22A and member 29A on the bottom surface of panel 23A so that the panels can be detachably connected. The packing board 18A also includes one fixed 40A and one detachable (preferably snap on) 42A zippered compartment (as above) attached to the top of panel 23A.

The panels 22A and 23A are attached to the luggage 10A at respective attachment ends 24A and 25A. In panel 23A, the attachment end 25A has a pair of hook and loop fastener strips 27A for releasably mating to a corresponding pair of hook and loop runs 104 (only one shown) to permit the packing board to be raised or lowered within the suitcase.

The attachment end 24A is preferably a fabric section that is bent downward to extend along the side 14A at the end of the luggage 10A. The attachment end 24A is preferably fastened to the luggage 10A with another hook and loop fastener having a pair of horizontal runs 100 (one shown) spacedly affixed to the attachment end 24A and a complementary pair of vertical runs 102 (one shown) stitched to the side 14A in alignment with the horizontal strip parts 100. The vertical runs 102 permit the height of panel 22A to be adjusted as needed. This hook and loop fastener preferably requires a greater separation force than the hook and loop fastener joining the panels 22A and 23A so that when panel 23A is pulled upward, the complementary members 28A and 29A disengage and panel 23A can be pivoted upward without disconnecting panel 22A from the luggage 10A.

It should be noted that other mechanical fasteners could be used for this purpose. For example, the attachment end 24A, 25A could include a pair of female snap connectors arranged to mate with multiple pairs of male snap connectors aligned vertically along the sides 14A. The hook and loop fastener is preferred, however, because it allows for a greater degree of adjustability.

The present invention has been shown and described herein in what is considered to be the most practical and preferred embodiments. It is recognized, however, that departures may be made therefrom within the scope of the invention and that obvious modifications will occur to a person skilled in the art. For example, the packing board could include three or more panels detachably or hingedly connected together and other suitable means for connecting the packing board to the luggage could be used.

Accordingly, reference must be had to the following claims in order to determine the full scope of the invention.

What is claimed is:

1. A packing board for dividing the storage volume of an item of luggage and for supporting items including clothing and accessories, the packing board comprising:

a first panel attachable at a first attachment end to an interior of the luggage; and a second panel attachable at a second attachment end to an interior of the luggage;

wherein the first and second panels are removably fastened together between the first and second attachment ends and wherein the first and second attachment ends comprise adjustable fasteners so that said first and second attachment ends are adjustably attachable to respective first and second ends of the luggage interior so that the packing board can be moved up and down within the luggage;

wherein the first panel includes at least one compartment for storing items, the at least one compartment being a zippered case removably attached to the first panel.

2. The packing board of claim 1, wherein the zippered case is transparent and water resistant.

3. A packing board for dividing the storage volume of an item of luggage and for supporting items including clothing and accessories, the packing board comprising:

a first panel attachable at a first attachment end to an interior of the luggage; and a second panel attachable at a second attachment end to an interior of the luggage;

wherein the first and second panels are removably fastened together between the first and second attachment ends and wherein the first and second attachment ends comprise adjustable fasteners so that said first and second attachment ends are adjustably attachable to respective first and second ends of the luggage interior so that the packing board can be moved up and down within the luggage;

wherein the first panel includes two compartments for storing items, wherein two zippered cases are attached to the first panel, one zippered case being removably fastened to the first panel and one zippered case being fixed to the first panel.

4. An item of luggage for carrying clothing and accessories when traveling, comprising;

a housing having a bottom and sides hingedly and reclosably connected to a top, said housing defining a vertical direction extending between said bottom and said top when said top is in a closed position;

a packing board including first and second panels having opposite luggage attachment ends and being removably fastened together between the first and second attachment ends so as to fit within the housing; and a first fasteners fixed at one end to one end of the luggage and slidably connected to the attachment end of the first panel and a second fastener fixed at one end to an opposite end of the luggage and slidably connected to the attachment end of the second panel;

wherein the fasteners can be operated to move the packing board up and down within the housing in said vertical direction and wherein the first and second panels can be separated and swung away from each other.

5. The luggage of claim 4, wherein the first and second panels are removably connected by a hook and loop fastener.

6. An item of luggage for carrying clothing and accessories when traveling, comprising:

a housing having a bottom and sides hingedly and reclosably connected to a top;

a packing board including first and second panels having opposite luggage attachment ends and being removably fastened together between the first and second attachment ends so as to fit within the housing; and a first fastener fixed at one end to one end of the luggage and slidably connected to the attachment end of the first panel and a second fastener fixed at one end to an opposite end of the luggage and slidably connected to the attachment end of the second panel;

wherein the fasteners can be operated to move the packing board up and down within the housing and wherein the first and second panels can be separated and swung away from each other, and wherein the first panel includes at least one compartment for storing items.

7. The luggage of claim 6, wherein the at least one compartment is a detachable zippered case.

8. The luggage of claim 7, wherein the detachable zippered case is transparent and water resistant.

9. The luggage of claim 8, wherein the first panel includes a second zippered case fixedly attached thereto.

10. An item of luggage for carrying clothing and accessories when traveling, comprising:

a housing having a bottom and sides hingedly and reclosably connected to a top;

a packing board including first and second panels having opposite luggage attachment ends and being removably fastened together between the first and second attachment ends so as to fit within the housing; and a first fastener fixed at one end to one end of the luggage and slidably connected to the attachment end of the first panel and a second fastener fixed at one end to an opposite end of the luggage and slidably connected to the attachment end of the second panel;

wherein the fasteners can be operated to move the packing board up and down within the housing and wherein the first and second panels can be separated and swung away from each other, and wherein the first and second fasteners are drawstrings, said drawstrings being loosenable to move the packing board up and down within the housing.

11. The luggage of claim 10, wherein at least one of said first and second drawstrings has a releasable clasp for securing a selected length of said drawstrings, wherein items contained within said luggage beneath said packing board can be secured and compressed.

* * * * *